United States Patent [19]

Haas et al.

[11] Patent Number: 4,675,689

[45] Date of Patent: Jun. 23, 1987

[54] GROOVED HORN RADIATOR WITH MODE COUPLER

[75] Inventors: Ludwig Haas, Putzbrunn; Klaus Moosmang, Taufkirchen, both of Fed. Rep. of Germany

[73] Assignee: Messerschmitt-Bölkow-Blohm GmbH, Munich, Fed. Rep. of Germany

[21] Appl. No.: 742,557

[22] Filed: Jun. 7, 1985

[30] Foreign Application Priority Data

Jun. 8, 1984 [DE] Fed. Rep. of Germany ..... 3421313

[51] Int. Cl.[4] ..... H01Q 13/02

[52] U.S. Cl. ..... 343/786

[58] Field of Search ..... 343/781 R, 786, 840

[56] References Cited

U.S. PATENT DOCUMENTS 4,199,764 4/1980 Frosch ..... 343/786

4,258,366 3/1981 Frosch ..... 343/786

FOREIGN PATENT DOCUMENTS 58-194401 11/1983 Japan .

*Primary Examiner*—Eli Lieberman

*Attorney, Agent, or Firm*—Toren, McGeady & Associates

[57] ABSTRACT

A horn radiator with a grooved inner surface has a mode coupler for a $TE_{01}$ wave and includes four cavity resonators embedded in the grooved surface of the horn and interconnected by an annular rectangular wave guide extending around the outer surface of the horn.

4 Claims, 2 Drawing Figures

GROOVED HORN RADIATOR WITH MODE COUPLER

BACKGROUND OF THE INVENTION

The invention is directed to a grooved horn radiator with a mode coupler for obtaining the ground wave and at least one higher wave type for self-follow up of an antenna on a moving radiation source emitting an electromagnetic wave. Wave portions of a higher wave type ($TE_{01}$) are coupled out at a plurality of locations on the inner circumferential surface of the horn and the wave portions are combined in an annular rectangular wave guide extending around the outer circumference of the horn radiator.

Such grooved horn radiators are used in ground station antennae in which equivalent field patterns of the ground waves in two main coordinate planes are required on the one hand and receiving devices for at least one higher wave type with a marked zero position in the center of the ground wave field patterns are necessary on the other hand for exact alignment of an antenna with a satellite.

A receiving antenna is disclosed in German Auslegeschrift No. 14 91 921 for the automatic tracking of a moving radiation source and the antenna comprises a smooth-walled horn radiator. An annular rectangular wave guide is arranged on this horn radiator in the coupling plane of the $TE_{01}$ wave type, and the wave energy of the $TE_{01}$ wave is transmitted from the horn radiator via four windows into the annular rectangular wave guide and a further rectangular wave guide leads away from the first mentioned wave guide. The additional wave guide contains a ground wave whose energy is proportional to the coupled out $TE_{01}$ wave type from the horn radiator. This type of coupling out of the $TE_{01}$ wave, however, is suitable only for thin-walled horn radiators with a smooth inner wall or surface.

SUMMARY OF THE INVENTION

Therefore, the primary object of the present invention is to provide a coupling out arrangement for the $TE_{01}$ wave type from a grooved horn radiator while influencing the ground wave as little as possible.

In accordance with the present invention, the coupling out device is formed by at least four cavity resonators embedded in the grooved structure extending outwardly from the inner circumferential surface of the horn. The resonators are arranged so that the radially inner surface of each is flush with the inner circumferential surface of the grooved horn and include coupling elements for the coupling out of the $TE_{01}$ wave from the interior of the grooved horn radiator and for coupling the cavity resonators in an annular rectangular wave guide laterally encircling the outer surface of the horn radiator.

Another advantageous feature of the present invention is that the cavity or resonators are arranged so as to be tuned. The cavity resonators have means for low-reflection adaptation to the coupling elements constructed in the form of dumbbell-shaped windows.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
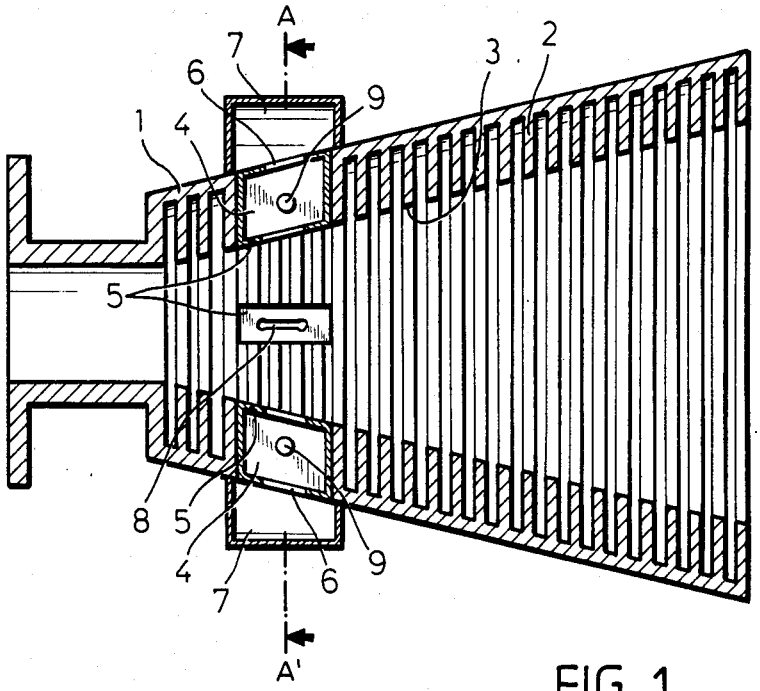
FIG. 1 is a simplified schematic axially extending section of a grooved horn radiator with a mode embodying the present invention.
Figure 2:
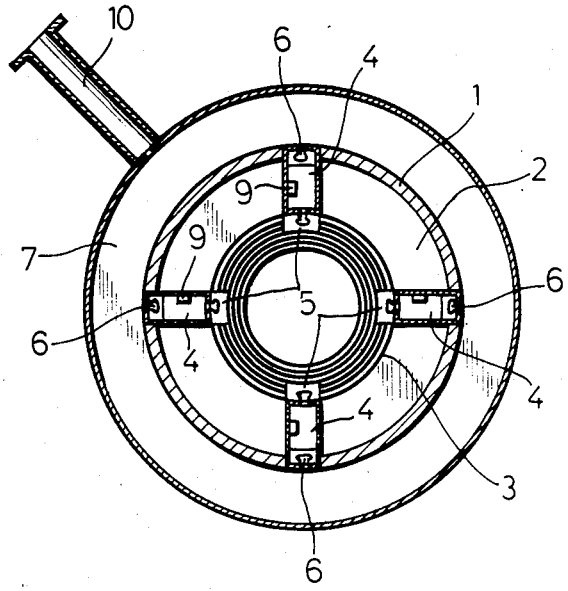
FIG. 2 is a sectional view taken along the line A—A' in FIG. 1.

FIG. 1 illustrates one embodiment of an interiorly grooved horn radiator embodying the present invention and having a mode coupler for the $TE_{01}$ wave type. The horn radiator has a conically shaped housing 1 with the inner surface 3 and the outer surface encircling a central axis and extending in the axial direction. The inner surface 3 is spaced radially inwardly from the outer surface. A grooved structure 2 is located in the inner surface 3 of the horn housing 1 with the grooves being spaced apart in the axial direction of the horn radiator. The grooves extend radially outwardly from the inner surface of the horn radiator in planes extending generally perpendicularly of the central axis of the horn radiator. The grooves extend radially outwardly from the inner surface to adjacent the outer surface of the housing 1. The mode coupler for the $TE_{01}$ wave type is formed of a group of four cavity resonators 4 spaced 90° apart around the inner surface of the housing 1 and embedded in the grooved structure 2 of the horn housing 1. The resonators 4 extend radially outwardly from the inner surface to the outer surface of the housing. Each resonator 4 has a coupling element 5 forming its radially inner surface and located in the region of the first maximum wall flow of the $TE_{01}$ wave as seen from the short-circuit plane of the wave. The coupling elements 5 are formed as diaphragms with apertures flush with the inside surface 3 of the grooved horn and dumbbell-shaped coupling slits 8 are formed in the diaphragm 5. These coupling slits 8 afford a low-reflection adaptation by varying the length and width of the slit and the diameter of the holes at the opposite ends. The resonance behavior of the cavity resonators can be influenced by tuning screws 9.

The transmission of the resonance wave in the cavity resonators 4 is effected through diaphragms 6 with dumbbell-shaped coupling slits opening into the annular rectangular wave guide 7 laterally encircling the outer surface of the horn housing 1.

The wave portions from the four cavity resonators 4 are combined in the wave guide 7. The coupling out from the wave guide 7 is effected through a window in a rectangular wave guide 10 which extends radially outwardly from the outside surface of the wave guide 7. Wave guide 10 can be adapted by tuning elements in a low-reflection manner.

The significant advantage of the interiorly grooved horn radiator with mode coupler, according to the present invention, involves the possibility of combining the advantages of a grooved horn with an advantageous coupling out of the $TE_{01}$ wave type which is particularly well suited for the self-follow up of the antenna.

While specific embodiments of the invention have been shown and described in detail to illustrate the application of the inventive principles, it will be understood that the invention may be embodied otherwise without departing from such principles.

We claim:

1. Grooved horn radiator with mode coupler for obtaining the ground wave and at least one higher wave type for self follow up of an antenna on a moving radiation source emitting an electromagnetic wave comprising a conically shaped horn housing having a central axis, a radially inner surface, and a radially outer surface with said radially inner surface spaced inwardly from said radially outer surface and having a plurality of grooves formed therein extending around the central axis and spaced apart in the direction of the central axis, said grooves extending radially outwardly from the radially inner surface toward said radially outer surface of said horn housing, means for coupling out portions of a higher wave type ($TE_{01}$) where coupling out is effected at a plurality of spaced locations around the radially inner surface of said horn housing, an annular rectangular wave guide for combining the coupled out portions, said coupling out means comprises at least four cavity resonators embedded in the grooved inner surface of said horn and extending radially outwardly therefrom, said resonators having a radially inner surface located flush with the radially inner surface of said horn housing and a radially outer surface, said annular wave guide encircling the radially outer surface of said horn housing and being open to the radially outer surface of said resonators, a first window in the radially inner surface of said resonators for coupling out the $TE_{01}$ wave form within the interior of said horn housing, a second window in the radially outer surface of said resonators for transmitting the wave portions from said resonators into said annular wave guide.

2. Grooved horn radiator, as set forth in claim 1, wherein means in the radially inner surface and the radially outer surface of said resonators for low-reflection adaptation affording the electromagnetic connection between said resonators and the interior of said horn housing and said annular rectangular wave guide.

3. Grooved horn radiator, as set forth in claim 1 or 2, wherein said cavity resonators are tunable.

4. Grooved horn radiator, as set forth in claim 1 or 2, wherein said means for low-reflection adaptation comprises dumbbell-shaped windows formed in the radially inner surface and the radially outer surface of said cavity resonators.

* * * * *